US007906196B2

(12) United States Patent
Contes et al.

(10) Patent No.: US 7,906,196 B2
(45) Date of Patent: Mar. 15, 2011

(54) BLOCKING STRIP FOR DIE STORAGE MEDIA

(75) Inventors: Andrew Contes, Chandler, AZ (US); David Carey, Phoenix, AZ (US); Travis Nice, Gillette, WY (US)

(73) Assignee: Intel Corporation, Santa Clara, CA (US)

( * ) Notice: Subject to any disclaimer, the term of this patent is extended or adjusted under 35 U.S.C. 154(b) by 683 days.

(21) Appl. No.: 11/941,888

(22) Filed: Nov. 16, 2007

(65) Prior Publication Data

US 2009/0130387 A1 May 21, 2009

(51) Int. Cl.
*D06N 7/04* (2006.01)

(52) U.S. Cl. ..... 428/141; 428/35.7; 428/343; 428/354; 206/713; 206/714; 206/716; 206/717

(58) Field of Classification Search ..... 428/139, 428/134, 343, 35.7, 141, 354; 206/714, 713, 206/716, 717

See application file for complete search history.

(56) References Cited

U.S. PATENT DOCUMENTS

2006/0011509 A1* 1/2006 White, Jr. ..... 206/714
2007/0074996 A1 4/2007 Nice et al.
2008/0000804 A1 1/2008 Carey et al.

* cited by examiner

*Primary Examiner* — Michael C Miggins
(74) *Attorney, Agent, or Firm* — Cool Patent, P.C.; Joseph P. Curtin

(57) ABSTRACT

A die storage method and apparatus comprising a cover tape and a strip coupled to the cover tape wherein the strip comprises a material that is: flexible or compressible, or combinations thereof.

19 Claims, 1 Drawing Sheet

BLOCKING STRIP FOR DIE STORAGE MEDIA

BACKGROUND

According to a particular embodiment, a semiconductor wafer may be diced into a number of individual electronic die comprising integrated circuits (ICs). The dice may be subsequently assembled into a package that is mounted to a printed circuit board. Prior to assembly on a printed circuit board, individual ICs may be transported by placing individual electronic die onto a flexible carrier tape comprising apertures. In a particular embodiment, the carrier tape may comprise cross-bars on the front and back of each aperture in the carrier tape. The assembly further includes a cover tape for securing the integrated circuits within the carrier tape. The carrier tape, cover tape and electronic die assembly may be rolled onto a reel that may be shipped and stored.

DETAILED DESCRIPTION

In the following detailed description, numerous specific details are set forth in order to provide a thorough understanding of claimed subject matter. However, it will be understood by those skilled in the art that claimed subject matter may be practiced without these specific details. In other instances, well-known methods, procedures, and components have not been described in detail so as not to obscure claimed subject matter.

The term 'pick and place process' is used in this description and is intended to refer to a process wherein a machine capable of picking a part from a loading station and placing the part at a delivery location is operating. The term 'storage media assembly' is used throughout this description and is intended to refer to an assembly capable of storing integrated circuits. The terms 'electronic die' and 'integrated circuit' are used interchangeably throughout this description. The term "length" is used throughout this description and is intended to refer to the longer of the two straight-line dimensions of a surface or plane or the longest of the three straight line dimensions of a solid. The term "width" is used throughout this description and is intended to refer to a measure taken at right angles to length and the term "thickness" is used throughout this description and is intended to refer to a perpendicular measurement downward from a surface. The term "Tape and Reel Die Sort (TRDS) machine' is used throughout this description and is intended to refer to a machine capable of picking-up individual electronic die and placing the electronic die into a carrier tape aperture and applying cover tape is to the carrier tape. A TRDS machine may comprise an output reel capable of winding up all the electronic die in carrier tape for storage.

Figure 1:
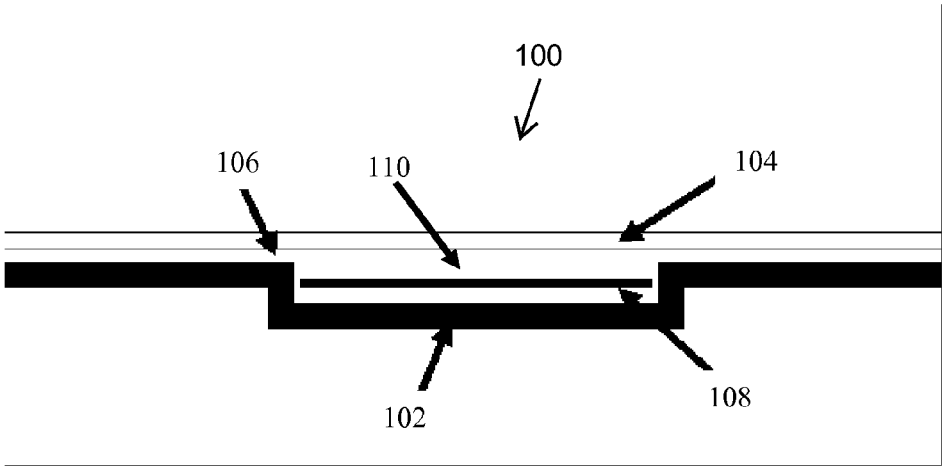
FIG. 1 is an elevation view of a particular embodiment of a carrier tape and cover tape assembly.

FIG. 1 illustrates an elevation view of storage media assembly 100. In a particular embodiment, storage media assembly 100 may comprise carrier tape 102 assembled to cover tape 104. In a particular embodiment, carrier tape 102 may comprise aperture 110 which may be covered by cover tape 104. According to a particular embodiment, a gap 106 may exist between carrier tape 102 and cover tape 104. In a particular embodiment, a number of electronic die 108 may be shipped and stored on reels (not shown) of carrier tape 102. During processing, electronic die 108 in aperture 110 may rotate through a number of vertical stations of a TRDS machine and traverse over a number of output reel bends. Electronic die 108 may be damaged by movement within aperture 110 and/or may migrate through gap 106 and out of aperture 110 during processing, transport and/or storage. In a particular embodiment, a lack of tension on cover tape 102 and/or air bubbles between carrier tape 102 and cover tape 104 may generate gap 106. If electronic die 108 migrates out of carrier tape 102, electronic die 108 may be damaged or lost during assembly, transport and/or storage.

Figure 2:
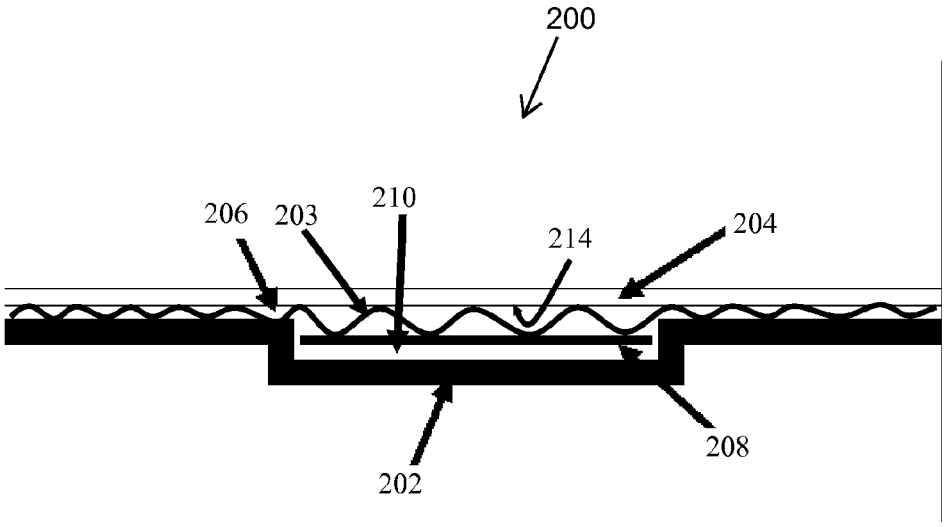
FIG. 2 is an elevation view of a particular embodiment of a carrier tape and cover tape assembly.

FIG. 2 illustrates an elevation view of storage media assembly 200. In a particular embodiment, storage media assembly 200 may comprise carrier tape 202 assembled to cover tape 204 which may be further assembled to strip 203. In a particular embodiment, carrier tape 202 may comprise aperture 210 which may be covered by cover tape 204. In a particular embodiment, strip 203 may comprise a variety of flexible and/or compressible materials, such as, for instance, plastic, rubber, natural fiber, man-made fiber, metal, glass and/or ceramic and claimed subject matter is not limited in this regard. In a particular embodiment, strip 203 may be disposed between carrier tape 202 and cover tape 204 and may substantially fill gap 206 where electronic die 208 may migrate out of pocket 210. In a particular embodiment, strip 203 may be capable of blocking electronic die 208 substantially preventing migration of electronic die 208 out of aperture 210 and/or dampening movement of electronic die 208 within aperture 210.

In a particular embodiment, strip 203 may be coupled to cover tape 204 by a variety of appropriate methods, materials and/or devices. Such methods, materials and/or devices may include, for instance, friction, adhesive, solder, pins, clips, hooks and/or Velcro® and claimed subject matter is not limited in this regard.

In a particular embodiment, strip 203 may be fed into storage media assembly 200 between carrier tape 202 and cover tape 204 during a pick and place process. In another embodiment, strip 203 may be pre-applied to adhesive side 214 of cover tape 204. In a particular embodiment, adhesive side 214 of cover tape 204 may have adhesive material only on outer edges (not shown) of cover tape 204. In a particular embodiment, when coupled to cover tape 204, strip 203 may comprise a variety of shapes, such as, for instance flat, folded, and/or corrugated and claimed subject matter is not limited in this regard.

As discussed above, in a particular embodiment, a number of electronic die 208 may be shipped and stored on reels (not shown) of carrier tape 202. Again, during processing, electronic die 208 in aperture 210 may rotate through a number of vertical stations of a TRDS machine and may traverse over a number of output reel bends. During transport and storage, electronic die 208 may be subjected to a variety of forces capable of causing movement or migration of electronic die 208. In a particular embodiment, strip 203 may be positioned within or may expand into aperture 210 substantially dampening movement and preventing migration of electronic die 208 during processing, transport and/or storage. Securing electronic die 208 in this way may substantially preventing electronic die 208 from being damaged or lost (migrating out of aperture 210) during assembly, transport and/or storage. Strip 203 may substantially prevent movement and/or migration of a variety of electronic die 208 sizes from about 75.0 μm in thicknesses and 2.5 mm in length by 2.5 mm in width to about 800.0 μm in thickness and 23.0 mm in width by 32.0 mm in length and claimed subject matter is not limited in this regard.

According to a particular embodiment, strip 203 may comprise a variety of dimensions. For instance, strip 203 may comprise any width from about 12.0 mm to 48.0 mm. In a particular embodiment, strip 203 may comprise any appropriate length to cover a desired length of cover tape 204, such as 40.0 m (standard reel length). According to a particular embodiment, strip 203 may comprise a variety of thicknesses. For instance, strip 203 may comprise a substantially uniform thickness of 0.2 mm to 1.14 mm or may comprise varied thicknesses. In a particular embodiment, strip 203 may be thicker in sections that may be disposed with aperture 210 enabling strip 203 to be positioned within or to expand into aperture 210. These are, however, merely examples of dimensions for strip 203 and claimed subject matter is not so limited.

Example 1

In this example, 20 electronic dice were processed by a TRDS machine and manually inserted into carrier tape pockets. Strips of two different compressible materials were fed between the cover tape and carrier tape as it was sealed in the TRDS machine. One strip comprised plastic bubble wrap and the other strip comprised plastic packaging material. Both strips of material expanded into pockets of the carrier tape and substantially held electronic die in position.

The dice were sealed in place by the TRDS machine. The adhesive of the cover tape was sufficient to keep the two strips in place.

After the dice were sealed into position by the TRDS machine, the tape was indexed 150 steps to cause the sealed dice in the tape to traverse over the output reel bend and down the vertical section of the machine and onto the output storage reel. During this index, none of the die migrated out of position. Furthermore, none of the dice were broken and the cover tape remained sealed to the carrier tape.

Example 2

In this example, 68 dice were tested. Thirty (30) dice were placed in a carrier tape pocket without a blocking strip and 38 dice were placed in a carrier tape pocket with a blocking strip. After processing through the TRDS machine, 25/30 (83.3%) of the dice migrated out of the carrier tape pockets without a blocking strip whereas only 2/38 (5.2%) dice migrated out of the carrier tape pockets with the blocking strip.

While certain features of claimed subject matter have been illustrated as described herein, many modifications, substitutions, changes and equivalents will now occur to those skilled in the art. It is, therefore, to be understood that the appended claims are intended to cover all such embodiments and changes as fall within the spirit of claimed subject matter.

What is claimed is:

1. A storage media for electronic die, comprising:

a carrier tape comprising one or more apertures, each aperture for receiving an electronic die;

a cover tape disposed over the carrier tape; and a strip disposed between the carrier and cover tapes, the strip comprising a substantially non-uniform thickness.

2. The storage media of claim 1, wherein the strip comprises a width from about 12 mm to 48 mm.

3. The storage media of claim 1 wherein, with respect to a surface of the cover tape, the strip is flat, folded, or corrugated, or combinations thereof.

4. The storage media of claim 1, wherein the strip comprises a material that is flexible or compressible, or combinations thereof.

5. The storage media of claim 4, wherein the material comprises plastic, rubber, natural fiber, man-made fiber, metal, glass or ceramic, or combinations thereof.

6. The storage media of claim 4, wherein the strip is coupled with the cover tape.

7. The storage media of claim 6, wherein the material comprises plastic, rubber, natural fiber, man-made fiber, metal, glass or ceramic, or combinations thereof.

8. The storage media of claim 7, wherein the strip is coupled to the cover tape via friction, adhesive, solder, pins, clips, hooks or Velcro®, or combinations thereof.

9. The storage media of claim 8, wherein the strip comprises a width from about 12 mm to 48 mm.

10. The storage media of claim 9, wherein, with respect to a surface of the cover tape, the strip is flat, folded, or corrugated, or combinations thereof.

11. The storage media of claim 1, wherein the strip is coupled with the cover tape.

12. The storage media of claim 11, wherein the strip is coupled to the cover tape via friction, adhesive, solder, pins, clips, hooks or Velcro®, or combinations thereof.

13. A storage media for electronic die, comprising:

a carrier tape comprising one or more apertures, each aperture for receiving an electronic die;

a cover tape disposed over the carrier tape, the cover tape comprising a surface; and a strip disposed between the carrier and cover tapes, with respect to the surface of the cover tape, the strip is corrugated.

14. The storage media of claim 13, wherein the strip comprises a substantially non-uniform thickness.

15. The storage media of claim 13, wherein the strip comprises a material that is flexible or compressible, or combinations thereof.

16. The storage media of claim 15, wherein the material comprises plastic, rubber, natural fiber, man-made fiber, metal, glass or ceramic, or combinations thereof.

17. The storage media of claim 13, wherein the strip comprises a width from about 12 mm to 48 mm.

18. The storage media of claim 13, wherein the strip is coupled with the cover tape.

19. The storage media of claim 18, wherein the strip is coupled to the cover tape via friction, adhesive, solder, pins, clips, hooks or Velcro®, or combinations thereof.

* * * * *

UNITED STATES PATENT AND TRADEMARK OFFICE

CERTIFICATE OF CORRECTION

PATENT NO. : 7,906,196 B2
APPLICATION NO. : 11/941888
DATED : March 15, 2011
INVENTOR(S) : Andrew Contes et al.

It is certified that error appears in the above-identified patent and that said Letters Patent is hereby corrected as shown below:

In column 4, line 6, in Claim 3, delete "claim 1" and insert -- claim 1, --, therefor.

Signed and Sealed this
Tenth Day of May, 2011

David J. Kappos

David J. Kappos
*Director of the United States Patent and Trademark Office*